US005362292A

United States Patent [19]

Borgström et al.

[11] Patent Number: 5,362,292

[45] Date of Patent: Nov. 8, 1994

[54] CENTRIFUGAL SEPARATOR

[75] Inventors: Leonard Borgström, Bandhagen; Claes-Göran Carlsson, Tumba; Peter Franzén, Tullinge; Claes Inge, Saltsjö-Duvnäs; Torgny Lagerstedt; Hans Moberg, both of Stockholm; Olle Nåbo, Tullinge, all of Sweden

[73] Assignee: Alfa-Laval Separation AB, Tumba, Sweden

[21] Appl. No.: 206,240

[22] PCT Filed: Feb. 13, 1991

[86] PCT No.: PCT/SE91/00100

§ 371 Date: Oct. 10, 1991

§ 102(e) Date: Oct. 10, 1991

[87] PCT Pub. No.: WO91/12082

PCT Pub. Date: Aug. 22, 1991

Related U.S. Application Data

[63] Continuation of Ser. No. 768,767, Oct. 10, 1991, abandoned.

[30] Foreign Application Priority Data

Feb. 15, 1990 [SE] Sweden ..... 9000540-6

[51] Int. Cl.[5] ..... B04B 1/08

[52] U.S. Cl. ..... 494/74; 494/79; 494/80

[58] Field of Search ..... 494/62, 65, 67, 80, 494/79, 74; 210/372

[56] References Cited

U.S. PATENT DOCUMENTS

| | | | |
|---|---|---|---|
| 2,302,381 | 11/1942 | Scott | 494/74 |
| 2,808,200 | 10/1957 | Wishaw | 494/67 |
| 2,946,777 | 7/1960 | Mertes | 494/65 |
| 3,245,542 | 4/1966 | Stevens | 210/377 |
| 3,356,223 | 12/1967 | Mercier | 210/377 |
| 3,482,771 | 12/1969 | Thylefors | 494/65 |
| 4,295,600 | 10/1981 | Saget | 494/74 |
| 4,701,158 | 10/1987 | Inge et al. | 494/74 |
| 4,721,505 | 1/1988 | Inge et al. | 494/74 |

FOREIGN PATENT DOCUMENTS

| | | | |
|---|---|---|---|
| 0933380 | 9/1955 | Germany | 494/67 |

*Primary Examiner*—David A. Scherbel
*Assistant Examiner*—Reginald L. Alexander
*Attorney, Agent, or Firm*—Seidel, Gonda, Lavorgna & Monaco

[57] ABSTRACT

A centrifugal separator of the type including a rotor, which is supported by a driving shaft and which forms a separation chamber and an inlet chamber. The inlet chamber being delimited by a dividing wall. An inlet tube extends axially through the dividing wall at one axial end of the inlet chamber at which the inlet channel in the tube opens. In the inlet chamber there is arranged a number of separating discs. A central part of the inlet chamber is connected to an outside space through an evacuating channel. In order to efficiently and gently separate a supplied liquid mixture without demanding a large space in the centrifugal separator, the inlet device is provided with a baffle which, between the opening of the inlet channel and the discs, extends from the rotational axis of the rotor and delimits a liquid filled inlet space. The liquid in the inlet space flowing during operation from the inlet channel radially outwards into the liquid body.

15 Claims, 3 Drawing Sheets

CENTRIFUGAL SEPARATOR

This is a continuation of co-pending application Ser. No. 07/768,767 filed on 10 Oct. 1991.

FIELD OF THE INVENTION

The present invention concerns a centrifugal separator comprising a rotor, which is supported by a driving shaft and forms a separation chamber and a centrally located inlet chamber, the latter communicating with the separation chamber through channels distributed around the rotational axis and being delimited by a dividing wall at one of its axial ends. The centrifugal separator also comprises an inlet tube having an inlet channel extending axially through the dividing wall and opening in the inlet chamber at said one of its axial ends, a stack of annular acceleration discs coaxial with the rotor, the discs being rotatable with the rotor and arranged at an axial distance from each other in the inlet chamber between the opening of the inlet channel and the second axial end of the inlet chamber to bring a supplied liquid during operation to rotate with the rotor and form a rotating liquid body in the inlet chamber. In the centrifugal separator there is arranged an evacuating channel, which connects a central part of the inlet chamber to a space outside the same.

BACKGROUND OF THE INVENTION

A problem in connection with centrifugal separators of this kind is to bring the liquid supplied through the inlet tube to rotate with the rotor without a dispersed phase of the liquid being splitted by the shearing forces acting on the same, which makes the following separation of this phase out of the liquid more difficult. An efficient and gentle acceleration of the liquid is thus desired for obtainment of a maximum separation result in the centrifugal separator. A kind of acceleration and entrainment member often used is wings, which extend axially and radially and are supported by the rotor in the inlet chamber. However, these wings give rise to heavy strains on the supplied liquid in the form of shocks and shearing forces. If the inlet chamber is not filled during the operation all the way to the centre, these wings cause, in addition, splashing of the incoming liquid, which means that air is mixed with the liquid.

A proposed solution of the described problem is shown in the U.S. Pat. No. 2,302,381. The centrifugal separator shown therein has a rotor, which inside itself forms a separation chamber and an inlet chamber, the latter communicating with the separation chamber. The liquid mixture of components, which are to be separated, is supplied to the inlet chamber centrally through an inlet channel in the vertical driving shaft of the rotor. Inside the inlet chamber there is arranged a stack of annular discs, which are rotatable with the rotor. The centre of the discs coincides with the rotational axis of the rotor. Centrally every disc has a circular opening, which openings together form a reception chamber for the supplied liquid mixture. Between themselves the discs form passages through which the liquid mixture is intended to flow radially outwards towards the separation chamber.

In the centrifugal separator known from U.S. Pat. No. 2,302,381 the inlet channel ends below the said reception chamber. The inlet channel has an opening directed axially towards the reception chamber, the flow through the opening being strongly restricted.

Upon supply of liquid mixture through the inlet channel, hereby, a jet is created, which passes through the reception chamber and hits a deflection member. This deflection member rotates with the rotor and deflects the liquid mixture in the jet radially outwards towards the annular discs, between which the liquid mixture flows further on towards the separation chamber.

In the passages between the discs the supplied liquid is brought to rotate with the rotor without being exposed to as heavy strains as entraining members in the form of wings give rise to in the same circumstances. On the contrary, both the strong restriction of the flow at the opening of the inlet channel and the collision between the created jet and the conical deflection member result in a strong turbulence and splitting of the components of the liquid mixture, which in many cases makes it impossible to achieve a satisfactory separation result.

In U.S. Pat. No. 4,721,505 there is shown an inlet device in a centrifugal separator, in which the supplied liquid mixture is intended to be accelerated in passages between discs of the same kind as the discs according to U.S. Pat. No. 2,302,381. In this inlet device the liquid mixture is supplied through a supply member to a central reception chamber, which is formed by central openings in the annular discs. An evacuating channel is connected to one of the axial ends of the reception chamber. Between the opening of the supply member in the reception chamber and the connection thereto of the evacuating channel a number of the discs are located. At the opening of the supply member a liquid body is maintained during operation, which extends through at least some of the passages between the discs. The supply member is so designed that the liquid mixture supplied through the same forms a liquid phase, which is continuous with the liquid body.

In the inlet device according to U.S. Pat. No. 4,721,505 the supply member extends axially through the central openings of a number of the discs. This limits the possible extension of the discs radially inwards, which in turn limits the entraining capability of the discs. In order to compensate for this and achieve the same maximum capacity the number of discs has to be increased, which means that the axial extension of the disc stack increases correspondingly. Besides, if the supply member is stationary it is necessary that there is a gap between this and the discs rotating with the rotor, which is big enough to prevent that the discs collide with the supply member when the rotor will oscillate. This means that the supply member has to be assembled with a very high degree of accuracy if the gap is not relatively big, which limits the radial extension of the discs further.

SUMMARY OF THE INVENTION

The object of the present invention is to accomplish a centrifugal separator with an inlet device which efficiently and gently can entrain a supplied liquid mixture without the need of requiring large space in the centrifugal separator.

This object is achieved according to the invention by providing the centrifugal separator initially described with a baffle, carried in the inlet chamber, intersecting the rotational axis of the rotor and extending radially outwards between the opening of the inlet chamber and the discs in a way such that a radially outer portion of the baffle during operation will be located in or dip into the rotating liquid around the rotational axis, and which delimits a liquid filled inlet space, which is separated from the rest of the inlet chamber, and through which liquid during operation of the rotor will flow radially outwards into the liquid body.

BRIEF DESCRIPTION OF THE DRAWINGS

The invention will be described in the following more closely with reference to the accompanying schematic drawings, in which the FIGS. 1–3 show different embodiments of a centrifugal separator according to the invention.

DESCRIPTION OF THE PREFERRED EMBODIMENTS

Figure 1:
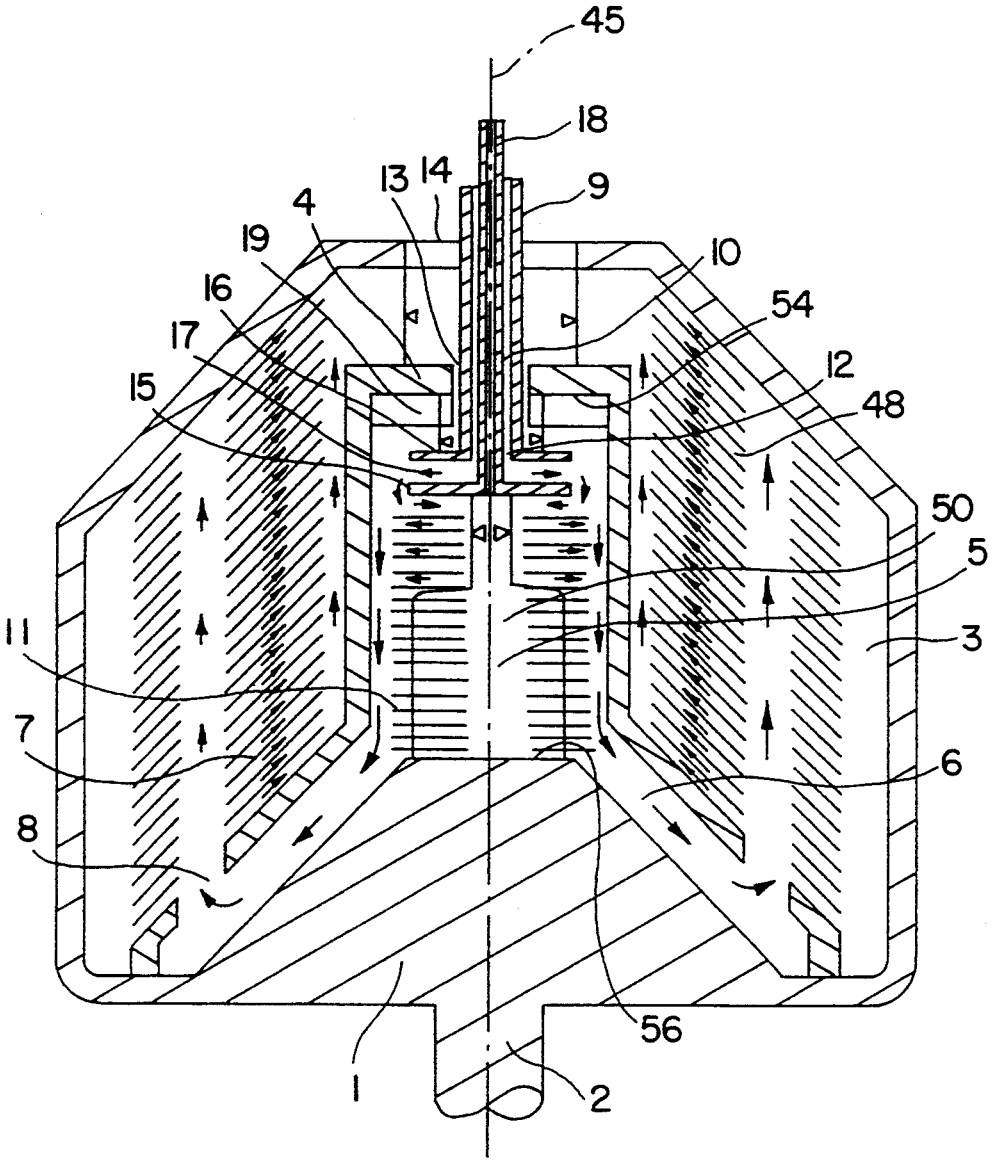

The centrifugal separator schematically shown in FIG. 1 has a rotor body 1, which is supported by a driving shaft 2. The rotor body forms inside itself a separation chamber 3. Centrally in the rotor there is arranged a wall element, which forms a dividing wall 4 and together with part of the rotor body delimits an inlet chamber 5. The inlet chamber 5 has a first end 45 and a second end 46 axially spaced. The dividing wall 4 defines the first end 45.

The inlet chamber 5 communicates with the separation chamber 3 through channels 6, which are formed between the wall element and the rotor body 1. In the separation chamber 3 there as arranged a stack of frusto-conical separation discs 7, which divide the Separation chamber 3 in a number of interspaces, in which the main separation is taking place. Axially through the stack of separations discs 7 a number of passages 8 extend, which are formed by just above each other located holes in the discs.

From above in FIG. 1 a stationary inlet tube 9 with an internal inlet channel 10 extends axially through a central opening in the rotor body 1 into the rotor and further on through a central opening in the dividing wall 4 into the inlet chamber 5, The inlet channel 10 has an opening 12 in proximity to the dividing wall 4. In the inlet chamber 5 there is arranged a stack of annular discs 11, which are rotatable with the rotor about a rotational axis 45, between the opening 12 of the inlet channel and the opposite end 46 of the inlet chamber 5. The discs 11 are kept at a distance from each other by means of distance means, which are arranged on the discs. Hereby, a number of passages or inner spaces 48 are formed between the discs 11. The stack formed by the discs 11 are fixedly joined to the rotor body 1 and/or the dividing wall. The object of the discs is to bring a supplied liquid during operation to rotate with the rotor and form a rotating liquid body in the inlet chamber 5. The discs 11 extend in a plan essentially perpendicular to the rotational axis of the rotor and their centre coincides with the rotational axis.

The stack of discs 11 forms a central space or part 50 of the inlet chamber 5. The central part of the inlet chamber 5 communicates with the space outside the same through an evacuating channel 13 in the form of a gap between the stationary inlet tube 9 and the edge of the central opening in the dividing wall 4. There is also a similar gap 14 between the stationary inlet tube 9 and the edge surrounding the central opening in the rotor body 1. Hereby, the central part of the inlet chamber 5 also communicates with the space outside the rotor body 1. Interposed between the opening 12 of the inlet channel and the discs 11 is a baffle 15. The baffle 15 intersects the rotational axis of the rotor and extends radially outwards or dips into the during operation rotating liquid body in the inlet chamber 5. The baffle 15 is in the embodiment shown in FIG. 1 stationary and fixedly joined with and supported by the stationary inlet tube 9. However, it is quite possible to fixedly connect the baffle 15 rotatable to the dividing wall and/or to the stack of the discs 11. The stationary inlet tube 9 is at its end in the inlet chamber 5 provided with an external annular flange 16. This flange 16 extends essentially parallel to the baffle 15 out into the during operation rotating liquid body in the inlet chamber. The baffle 15 and the flange 16 delimit between them an inlet space 17, which during operation is filled with supplied liquid, which flows from the inlet channel 10 radially outwards into the rotating liquid body. Centrally through the inlet tube 9 and the baffle 15 an evacuating channel 18 extends, which connects the central, during operation gas filled, part of the inlet chamber 5 below the baffle 15 to the surrounding of the rotor. Through this evacuating channel gas, which during operation is located radially inside the rotating liquid body in this part of the inlet chamber 5, can flow out of the inlet chamber 5.

In the inlet chamber 5 a number of radially extending wings 19 also can be arranged on the dividing wall 4 in the space between the flange 16 and the evaporating channel 13. Hereby it is guaranteed that the liquid, which is located during operation in this space, is entrained with the rotation of the rotor enough efficiently to maintain the free liquid surface of the rotating liquid body in this space radially outside the evacuating channel 13.

Figure 2:
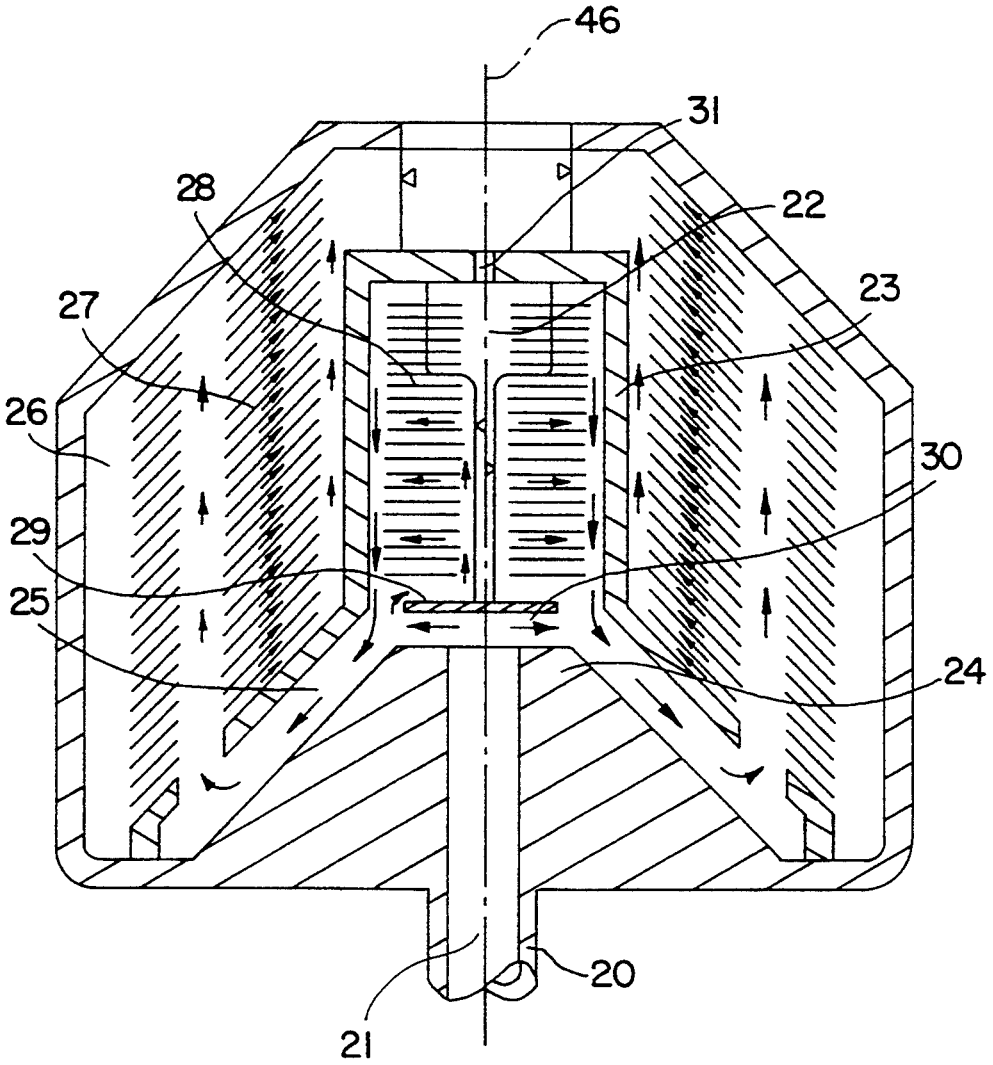

The centrifugal separator schematically shown in FIG. 2 differs from the centrifugal separator shown in FIG. 1 in that the inlet tube consists of the driving shaft 20 rotating with the rotor, which inside itself forms an inlet channel 21. The inlet channel 21 opens in an inlet chamber 22, which in the same manner as in FIG. 1 is delimited partly by the rotor body, partly by the wall element 23. In this case the rotor body forms the dividing wall 24, through which the inlet channel extends into the inlet chamber 22. The inlet chamber communicates through a number of channels 25 with a separation chamber 26, which is formed in the rotor and is provided with a stack of frusto-conical separation discs 27. As in FIG. 1 a number of annular acceleration discs 28 rotatable with the rotor about a rotational axis 46 are arranged centrally in the inlet chamber 22 between the opening of the inlet channel 21 and the opposite end of the inlet chamber. These discs 28 are also kept at a distance from each other by means of distance means, which are arranged on the discs 28. The stack formed by these discs 28 is fixedly joined with the rotor body 1 and/or the dividing wall. Between these discs 28 and the opening of the inlet channel 21 there is arranged a baffle 29, which intersects the rotational axis of the rotor and extends radially outwards into the during operation rotating liquid body in the inlet chamber 22. The baffle 29 is in this embodiment rotatable with the rotor and is preferably fixedly connected to the part of the rotor which forms the dividing wall 24. Together with the dividing wall 24 the baffle 29 forms an inlet space 30, which during operation is filled with liquid, which flows from the inlet channel 21 radially outwards into the rotating liquid body. Centrally through the wall element 23 at its opposite end an evacuating channel 31 extends, which connects a central part of the inlet chamber 22, which during operation is filled with a gas, to a gas filled space outside the inlet chamber 22. In this embodiment the channels 25 between the inlet chamber 22 and the separation chamber 26 are connected to the inlet chamber 22 at the end of the same, at which the inlet channel 22 opens, i.e. on the same side of the entraining discs 28 as the opening of the inlet channel 21.

Figure 3:
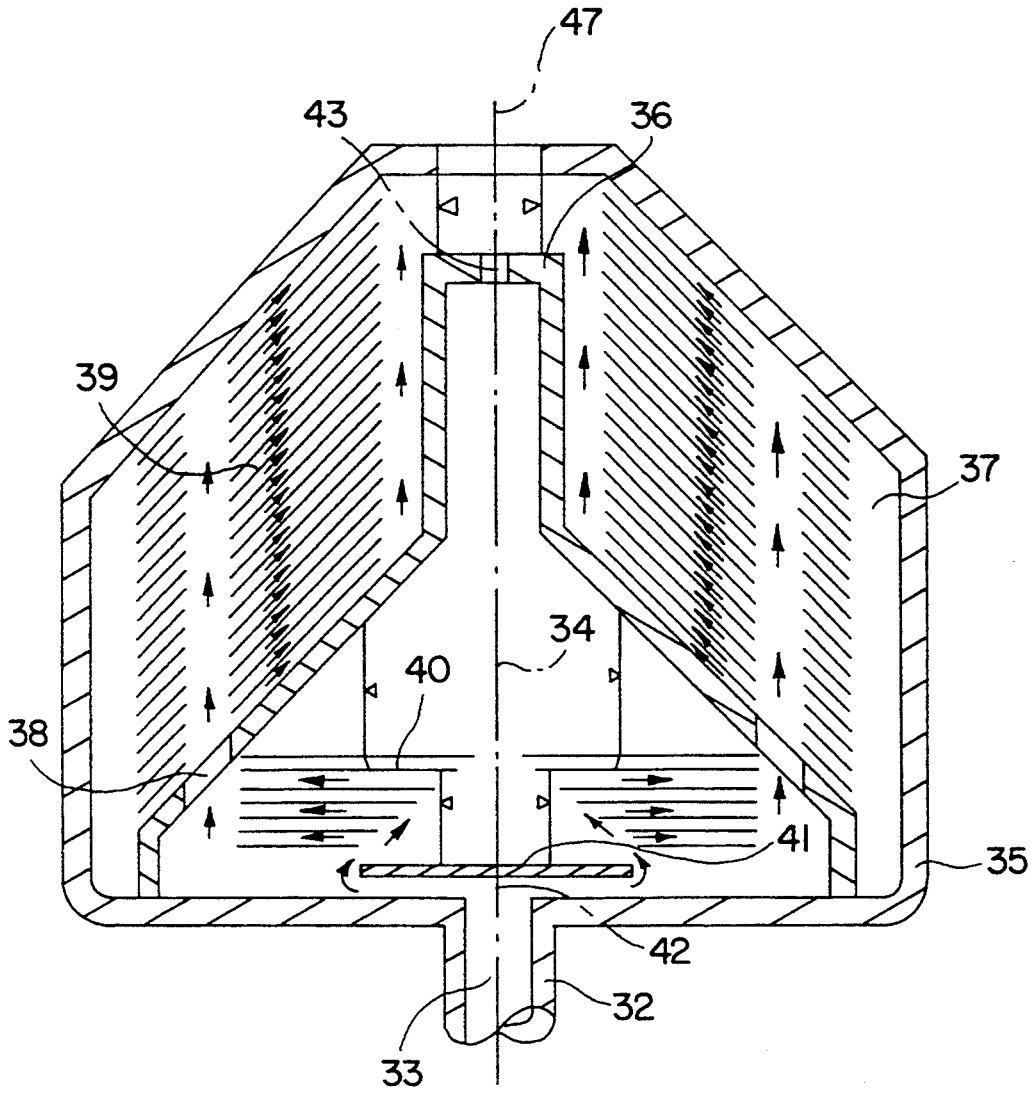

The centrifugal separator schematically shown in FIG. 3 has an inlet tube, which in the same manner as the inlet tube in the embodiment shown in FIG. 2 consists of the driving shaft 32 rotating with the rotor about a rotational axis 47. This driving shaft 32 forms an inlet channel 33 too, which opens into the central inlet chamber 34. The inlet chamber 34, which is delimited partly by the rotor body 35, partly by the wall element 36, is surrounded by a separation chamber 33 and communicates with it through channels 38. In the separation chamber 37 there is arranged a stack of frusto-conical separation discs 39. The dividing wall, which delimits the inlet chamber 34, and through which the inlet channel 33 extends, is also in this embodiment formed by a part of the rotor body 35. The inlet channel 33 opens into one axial end of the inlet chamber 34 and between this end and its opposite end there is arranged a stack of a number of annular discs 40 rotatable with the rotor provided with distance means to bring during operation a supplied liquid to rotate with the rotor and form a rotating liquid body in the inlet chamber 34. The stack of the discs 40 is as a suggestion fixedly connected to the rotor body but can also be fixedly connected to the wall element 36. The discs 40 extend essentially in a plan perpendicular to the rotational axis of the rotor and the centre of them coincides with the rotational axis. Between the discs 40 and the opening of the inlet channel 33 there is arranged a baffle 41, which is fixedly connected to the rotor body 35, together with which it forms an inlet space 42. In this embodiment the discs 40 have a central hole, the diameter of which decreases with the distance from the baffle 41. Centrally through the wall element 36 at the opposite end of the inlet chamber 34 there is an evacuating channel 43, which connects central spaces of the rotor, which during operation are filled with gas, to each other.

In this embodiment the channels 38, which connect the inlet chamber 34 to the separation chamber 37, are connected to the inlet chamber 34 radially outside the discs 40, at the end of the disc stack, which is turned from the inlet channel.

The centrifugal separator shown in FIG. 1 functions in the following manner.

While the rotor is rotating the liquid mixture components, which are to be separated, is supplied through the inlet channel 10 and the inlet space 17 to the inlet chamber 5. In the inlet chamber the liquid passes in thin layers between the entraining discs 11, which brings the liquid to rotate and form a rotating liquid body in the inlet chamber with a radially inwards directed free liquid surface. The inlet space 17 is then filled, whereby the liquid flowing through the inlet channel 10 and the inlet space 17 forms a continuous liquid phase with a liquid body rotating in the inlet chamber 5. To guarantee when the supply flow of liquid is high that the free liquid surface of the part of the rotating liquid body, which is located above the inlet space 17, does not move radially inwards further than to the radially innermost edge of the dividing wall 4, the liquid in this part of the inlet chamber is also entrained by a number of radially wings 19.

The liquid mixture flows from the inlet chamber 5 through the channel 6 and further up through the passages 8. From the passages 8 the mixture is distributed out into the different interspaces between the separation discs 7 where the main separation is taking place.

During the separation in these interspaces a specific heavier component is separated from a specific lighter component influenced by the centrifugal force. The specific lighter component then flows radially inwards between the discs and further towards a central outlet, which in the figure is shown in the form of a overflow outlet. The specific heavier component flows radially outwards in the interspace and is accumulated in the radially outermost part of the separation chamber 3.

The centrifugal separators shown in FIGS. 2 and 3 also function in a corresponding manner.

At a certain inlet flow of the liquid mixture to the centrifugal separators shown in the figures the free liquid surface of the rotating liquid body in the inlet chamber 5 takes the positions, which are illustrated by the continuous lines and small triangles in the figures. If the inlet flow of the mixture increases the liquid surface will be displaced radially in a way such that the liquid flows in more and more interspaces between the entraining discs. In the embodiment shown in FIG. 3 bigger and bigger entraining discs will, in addition, be active when the supply of the mixture increases, whereby a great need of entrainment can be satisfied.

By designing a centrifugal separator in this manner with an inlet device, which efficiently and gently entrains the supplied mixture without demanding a large space in the centrifugal separator, a space in the same is made free, which, for instance, can be used for an outlet device, such as a paring device.

We claim:

1. A centrifugal separator comprising:

a rotor supported by a driving shaft and rotatable about a rotational axis, the rotor forming a separation chamber and a centrally located inlet chamber, the inlet chamber having a first and a second axially spaced end and communicating with the separation chamber through channels distributed around the rotational axis, a wall delimiting the inlet chamber at the first end, an inlet means forming an inlet channel, said inlet channel extending through said wall and having an opening within the inlet chamber at said first end, a stack of annular acceleration discs mounted in the inlet chamber coaxial with the rotor for rotation therewith and spaced from each other axially, the stack of discs being positioned between said opening of the inlet channel and the second end of said inlet chamber and, further, forming a central space communicating with the interspaces between the discs, the discs being adapted to entrain in rotation liquid flowing into the disc interspaces from said central space, such that a rotating liquid body having a free liquid surface is formed in the inlet chamber during rotation of the rotor, means forming an evacuation passage connecting said space formed by the disc stack and a space outside the inlet chamber, and a baffle carried in the inlet chamber and extending substantially from the rotational axis of the rotor radially outward to a radial level such that a radially outer portion of the baffle will be located in said rotating liquid body all around the rotational axis of the rotor during rotation of the rotor, the baffle being positioned between said opening of the inlet channel and the stack of discs, thereby directing liquid supplied through the inlet channel to the inlet chamber to flow from said opening of the inlet channel radially outward into said liquid body before entering central space formed in the disc stack.

2. A centrifugal separator according to claim 1, wherein the inlet means is stationary and extends axially through a central opening in the dividing wall.

3. A centrifugal separator according to claim 2, wherein a circular flange is arranged on the outside of the inlet means, the flange extending during operation radially outwards into the rotating liquid body around the rotational axis and forming together with the baffle an inlet space.

4. A centrifugal separator according to claim 1, wherein the inlet means is rotatable with the rotor and connected to the dividing wall.

5. A centrifugal separator according to claim 4, wherein the inlet means consists of the driving shaft.

6. A centrifugal separator according to claim 1, wherein said baffle is fixedly joined to the rotor.

7. A centrifugal separator according to claim 1, wherein said baffle is fixedly joined to the inlet means.

8. A centrifugal separator according to claim 2, wherein said baffle is fixedly joined to the rotor.

9. A centrifugal separator according to claim 3, wherein said baffle is fixedly joined to the rotor.

10. A centrifugal separator according to claim 4, wherein said baffle is fixedly joined to the rotor.

11. A centrifugal separator according to claim 5, wherein said baffle is fixedly joined to the rotor.

12. A centrifugal separator according to claim 3, wherein said baffle is fixedly joined to the inlet means.

13. A centrifugal separator according to claim 3, wherein said baffle is fixedly joined to the inlet means.

14. Centrifugal separator according to claim 1, wherein said channels through which the inlet chamber communicates with the separation chamber open into the inlet chamber on the axial side of said baffle facing said second end of the inlet chamber.

15. Centrifugal separator according to claim 1, wherein said channels through which the inlet chamber communicates with the separation chamber open into the inlet chamber at said second end thereof.

* * * * *